US010950373B2

(12) United States Patent
Namkung et al.

(10) Patent No.: US 10,950,373 B2
(45) Date of Patent: Mar. 16, 2021

(54) HOT-PRESSED AND DEFORMED MAGNET COMPRISING NONMAGNETIC ALLOY AND METHOD FOR MANUFACTURING SAME

(71) Applicant: LG ELECTRONICS INC., Seoul (KR)

(72) Inventors: Seok Namkung, Seoul (KR); Deokhai Park, Seoul (KR); Namseok Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 162 days.

(21) Appl. No.: 15/521,131

(22) PCT Filed: Dec. 8, 2014

(86) PCT No.: PCT/KR2014/012006
§ 371 (c)(1),
(2) Date: Apr. 21, 2017

(87) PCT Pub. No.: WO2016/093379
PCT Pub. Date: Jun. 16, 2016

(65) Prior Publication Data
US 2017/0330658 A1 Nov. 16, 2017

(51) Int. Cl.
*H01F 1/057* (2006.01)
*B22F 3/14* (2006.01)
(Continued)

(52) U.S. Cl.
CPC ..... *H01F 1/0577* (2013.01); *B22F 3/14* (2013.01); *C22C 1/0475* (2013.01); *C22C 12/00* (2013.01);
(Continued)

(58) Field of Classification Search
CPC .. B22F 2998/10; B22F 2003/248; B22F 3/02; B22F 3/10; B22F 3/14; B22F 2999/00;
(Continued)

(56) References Cited

U.S. PATENT DOCUMENTS 4,765,848 A * 8/1988 Mohri ..... H01F 1/057 148/302
4,978,398 A * 12/1990 Iwasaki ..... C22C 1/0441 148/101
(Continued)

FOREIGN PATENT DOCUMENTS

CN 101640087 A 2/2010
CN 103098155 A 5/2013
(Continued)

OTHER PUBLICATIONS

Tang, Xin, et. al.. "Enhanced Texture in Die-Upset Nanocomposite Magnets by Ng—Cu Grain Boundary Diffusion." Applied Physics Letters, vol. 102, No. 7, 2013, p. 072409 (Year: 2013).*
(Continued)

*Primary Examiner* — Paul A Wartalowicz
*Assistant Examiner* — Ryan L Heckman
(74) *Attorney, Agent, or Firm* — Birch, Stewart, Kolasch & Birch, LLP

(57) ABSTRACT

An R-TM-B hot-pressed and deformed magnet (here, R represents a rare earth metal selected from the group consisting of Nd, Dy, Pr, Tb, Ho, Sm, Sc, Y, La, Ce, Pm, Eu, Gd, Er, Tm, Yb, Lu, and a combination thereof, and TM represents a transition metal) of the present invention comprises flat type anisotropic magnetized crystal grains and a nonmagnetic alloy distributed in a boundary surface between the crystal grains, and thus the magnet of the present invention has an excellent magnetic shielding effect as compared with an existing permanent magnet since the crystal gains can be
(Continued)

completely enclosed in the nonmagnetic alloy, so that a hot-pressed and deformed magnet with enhanced coercive force can be manufactured through a more economical process.

1 Claim, 1 Drawing Sheet

(51) Int. Cl.

| | |
|---|---|
| ***C22C 28/00*** | (2006.01) |
| ***C22C 38/00*** | (2006.01) |
| ***C22C 12/00*** | (2006.01) |
| ***C22C 23/06*** | (2006.01) |
| ***C22C 38/16*** | (2006.01) |
| ***C22C 38/10*** | (2006.01) |
| ***C22C 21/00*** | (2006.01) |
| ***C22C 1/04*** | (2006.01) |
| ***C22C 33/02*** | (2006.01) |
| ***H01F 41/02*** | (2006.01) |

(52) U.S. Cl.
CPC ..... *C22C 21/00* (2013.01); *C22C 23/06* (2013.01); *C22C 28/00* (2013.01); *C22C 33/0278* (2013.01); *C22C 38/002* (2013.01); *C22C 38/005* (2013.01); *C22C 38/10* (2013.01); *C22C 38/16* (2013.01); *H01F 1/0576* (2013.01); *H01F 41/0293* (2013.01); *B22F 2998/10* (2013.01); *C22C 2200/04* (2013.01); *C22C 2202/02* (2013.01)

(58) Field of Classification Search
CPC . B22F 2203/11; C22C 2202/02; C22C 28/00; C22C 33/0278; C22C 38/00; C22C 38/002; C22C 38/005; C22C 38/10; H01F 1/0577; H01F 41/0266
See application file for complete search history.

(56) References Cited

U.S. PATENT DOCUMENTS

| | | | | |
|---|---|---|---|---|
| 5,100,485 | A * | 3/1992 | Yamashita | H01F 41/0273 148/101 |
| 5,125,988 | A * | 6/1992 | Akioka | B22F 9/023 148/101 |
| 5,536,334 | A * | 7/1996 | Kobayashi | H01F 1/057 148/101 |
| 7,048,808 | B2 * | 5/2006 | Kaneko | H01F 1/0577 148/101 |
| 8,038,807 | B2 | 10/2011 | Morimoto et al. | |
| 8,846,136 | B2 * | 9/2014 | Shoji | H01F 1/0576 427/127 |
| 2013/0195710 | A1 * | 8/2013 | Haga | H01F 41/005 419/27 |
| 2014/0132376 | A1 * | 5/2014 | Jin | H01F 1/0552 335/302 |
| 2014/0308441 | A1 * | 10/2014 | Shoji | H01F 1/0577 427/129 |
| 2015/0132178 | A1 * | 5/2015 | Suzuki | H01F 1/0577 420/83 |
| 2015/0279529 | A1 * | 10/2015 | Ichigozaki | C22C 38/00 419/28 |
| 2015/0279559 | A1 * | 10/2015 | Miyamoto | B22F 3/14 419/38 |
| 2016/0314899 | A1 * | 10/2016 | Sakuma | B22F 1/0003 |

FOREIGN PATENT DOCUMENTS

| | | | |
|---|---|---|---|
| CN | 103227019 | A | 7/2013 |
| EP | 0378698 | A1 | 7/1990 |
| EP | 1154445 | A2 | 11/2001 |
| JP | 9-170055 | A | 6/1997 |
| JP | 9-275004 | A | 10/1997 |
| JP | 2001-323343 | A | 11/2001 |
| JP | 2012-49492 | A | 3/2012 |
| JP | 2012-234985 | A | 11/2012 |
| JP | 2013-110387 | A | 6/2013 |
| JP | 2013-149862 | A | 8/2013 |
| JP | 2014-93391 | A | 5/2014 |
| KR | 10-1998-043534 | A | 9/1998 |
| KR | 10-1087574 | B1 | 11/2011 |
| WO | WO 2011/145674 | A1 | 11/2011 |
| WO | WO 2012/036294 | A1 | 3/2012 |
| WO | WO 2014/069181 | A1 | 5/2014 |

OTHER PUBLICATIONS

Sawatzki, Simon, et al. "Coercivity Enhancement in Hot-Pressed Nd—Fe—B Permanent Magnets with Low Melting Eutectics." Journal of Applied Physics, vol. 115, No. 17, 2014 (Year: 2014).*

Wan, Fangming, et al. "Coercivity Enhancement in Dy—Free Nd—Fe—B Sintered Magnets by Using Pr—Cu Alloy." Journal of Applied Physics, vol. 115, No. 20, 2014, p. 203910 (Year: 2014).*

Sepehri-Amin, H., et al. "Coercivity Enhancement of Hydrogenation-Disproportionation-Desorption-Recombination Processed Nd—Fe—B Powders by the Diffusion of Nd—Cu Eutectic Alloys." Scripta Materialia, vol. 63, No. 11, 2010, pp. 1124-1127 (Year: 2010).*

Tang et al., "Impact of Nd—Cu Diffusion On Microstructure And Coercivity In Hot-Pressed And Die-Upset Nanocomposite Magnets", Scripta Materialia, vol. 88, 2014, pp. 49-52.

T. Akiya et al., "High-coercivity hot-deformed Nd—Fe—B permanent magnets processed by Nd—Cu eutectic diffusion under expansion constraint", Scripta Materialia, 2014, 4 pages.

* cited by examiner

[Fig. 1]
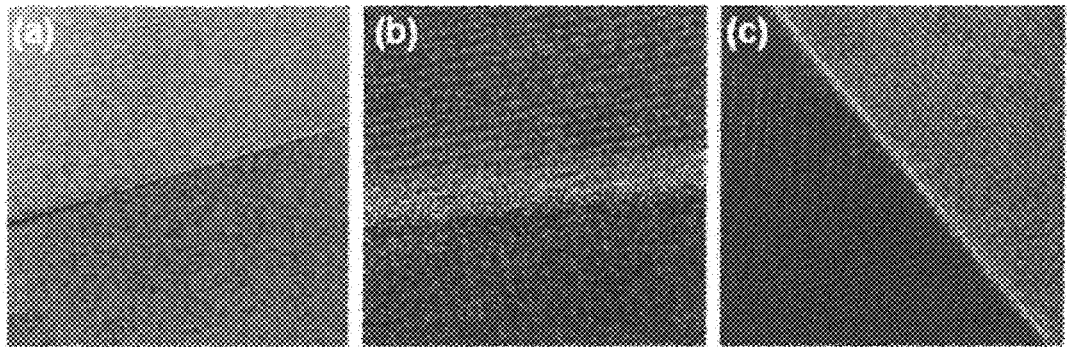
[Fig. 2]
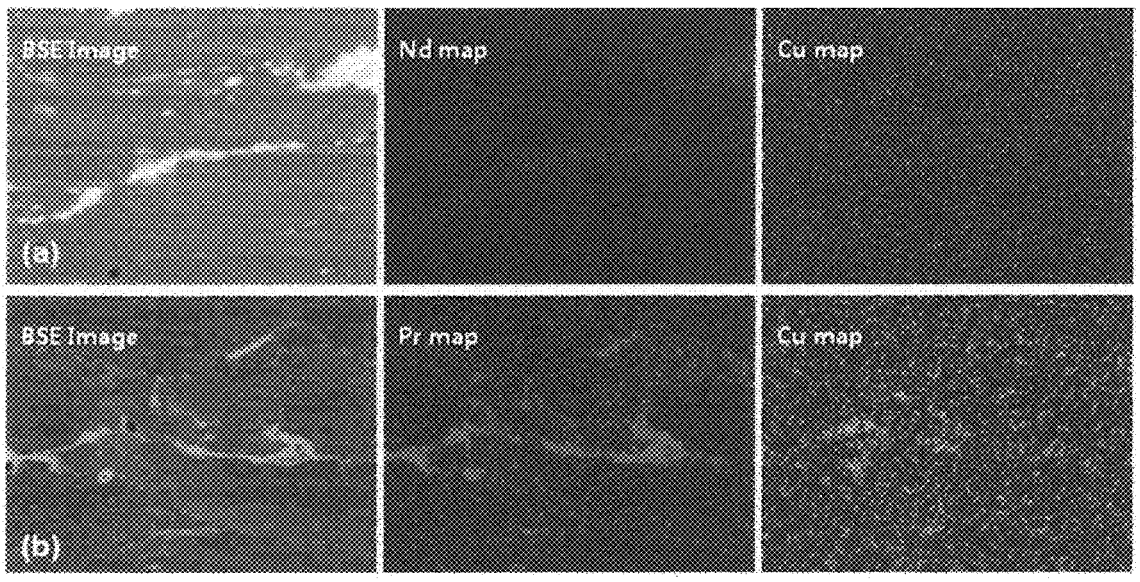
[Fig. 3]
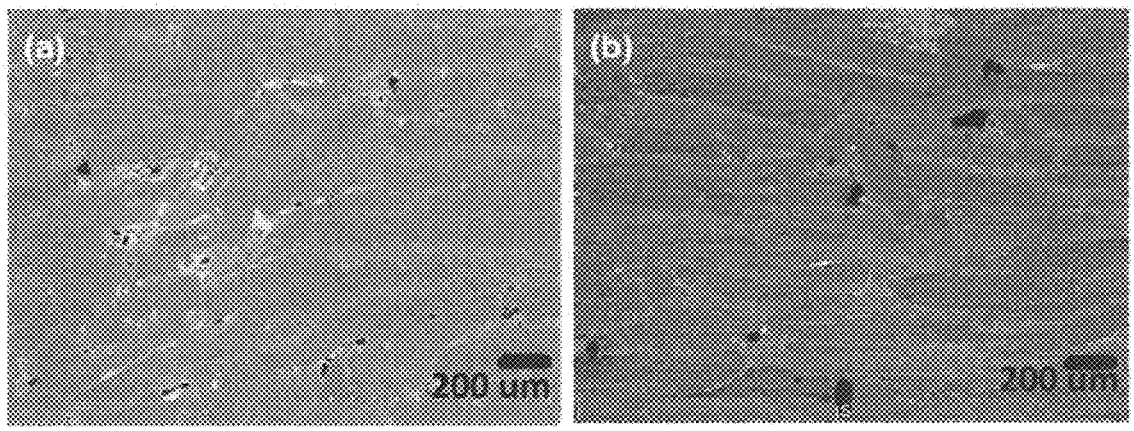

HOT-PRESSED AND DEFORMED MAGNET COMPRISING NONMAGNETIC ALLOY AND METHOD FOR MANUFACTURING SAME

CROSS REFERENCE TO RELATED APPLICATIONS

This application is the National Phase of PCT International Application No. PCT/KR2014/012006, filed on Dec. 8, 2014, which is hereby expressly incorporated by reference into the present application.

TECHNICAL FIELD

The present invention relates to a hot-pressed and deformed magnet comprising a non-magnetic alloy distributed at the crystal grain interface, and more particularly, to a method for improving the coercive force of a permanent magnet and improving the residual magnetic flux density without the need for the application of a magnetic field by effectively achieving the magnetic shielding unlike a permanent magnet by means of an existing process.

BACKGROUND ART

Recently, the environmentally friendly energy industry such as the new renewable energy has drawn great attention, but it may also be important to improve the efficiency of a device which consumes energy in terms of conversion of the energy production system and energy consumption. The most important device, which is associated with the energy consumption, is a motor, and the essential material for the motor is a rare earth permanent magnet. In order for the rare earth permanent magnet to be used as an excellent material in various application fields, both high residual magnetic flux density (Br) and stable coercive force (iHc) are required.

One of the methods for securing high coercive force of a magnetic powder is a method for using the magnetic powder by adding a heavy rare earth such as Dy to increase coercive force at room temperature. However, it seems that there is a limitation in recently using a heavy rare earth metal such as Dy as a material in the future due to the scarcity of the heavy rare earth metal and a soaring increase in prices resulting therefrom. Further, the addition of Dy improves coercive force, but has a disadvantage in that the remanence is reduced, and as a result, the intensity of the magnet becomes weak.

Meanwhile, in a method for manufacturing an anisotropic neodymium-based permanent magnet, the magnet is usually manufactured by preparing a magnetic powder through metal melting, rapid cooling, and milling, forming the magnetic powder while applying a magnetic field, and then sintering the magnetic powder at high temperature (1,000° C. or more), and subjecting the magnetic powder to post-heat treatment. During the process, among the methods for securing high coercive force of a magnetic powder, there is a method for the micronization of the size of crystal grains to the single magnetic domain size.

That is, the method is to micronize crystal grains of the magnetic powder by minutely pulverizing the grains by means of a physical method, and in this case, it is also necessary to micronize the particle diameter of the magnetic powder itself prior to the sintering in the steps of the manufacturing method in order to micronize the crystal grains of the magnetic powder, but there is also a need for maintaining the magnetic powder of the micro crystal grains until a final product is produced.

However, in the process of manufacturing a minutely pulverized magnetic powder having a micro-size particle diameter into a magnet, the coercive force is significantly reduced because the growth of crystal grains occurs due to the high temperature heat treatment exceeding 1,000° C., crystal grains are produced in the form of a single magnetic domain due to the crystal grain coarsening, and a reverse magnetic domain in the particle is easily formed.

Meanwhile, the isolation of crystal grains is induced by using still another method among the methods for securing high coercive force to achieve the magnetic shielding, and as a result, the coercive force may be increased by blocking the transition of the reverse magnetic domain. For this purpose, in the related art, a method for allowing a non-magnetic phase to diffuse inside a magnet by applying or coating the non-magnetic phase on the surface of the magnet is used (U.S. Ser. No. 08/038,807 B1, WO 2011/0145674, T. Akiya et al (2014)).

However, this method fails to uniformly isolate crystal grains because the non-magnetic phase is abundant only on the surface of the magnet, diffusion does not smoothly occur, and as a result, the non-magnetic phase becomes insufficient inside the magnet. Therefore, since it is difficult to apply the method to large-sized magnets, and magnetic characteristics inside and outside of the magnet are different from each other in this case, there is a concern in that a non-uniform magnet is produced.

DISCLOSURE OF THE INVENTION

Therefore, an object of the present invention is to provide a hot-pressed and deformed magnet in which the coercive force is improved as an effect of the magnetic shielding due to a uniform distribution of a non-magnetic alloy at the interface of crystal grains, the magnetization direction is aligned in one direction due to a hot-press and deformation process, and as a result, the residual magnetic reflux density is improved, and a method for manufacturing a hot-pressed and deformed magnet in which a non-magnetic alloy is uniformly distributed at the interface of crystal grains by mixing the non-magnetic alloy during the process of manufacturing the magnet.

Hereinafter, the present invention will be described in more detail.

A method for manufacturing an R-TM-B hot-pressed and deformed magnet according to the present invention, the method including the steps of: (a) preparing a magnetic powder from an R-TM-B (R means any one rare earth metal selected from the group consisting of Nd, Dy, Pr, Tb, Ho, Sm, Sc, Y, La, Ce, Pm, Eu, Gd, Er, Tm, Yb, Lu, and a combination thereof, and TM means a transition metal) alloy; (b) manufacturing a sintered body by press sintering the magnetic powder; and (c) hot-pressing and deforming (hot deformation) the sintered body by applying heat and pressure, in which the method includes adding a non-magnetic alloy at the time of manufacturing the R-TM-B alloy in Step (a) or before the press sintering in Step (b).

The magnetic powder in Step (a) may be manufactured by pulverizing an alloy ingot having an R-TM-B-based composition, and the R-TM-B-based ingot may be manufactured by, for example, an HDDR process, a melt spinning process, or a rapid solidification process, and the like. Specifically, an ingot having a ribbon shape may be manufactured by a system of melting the alloy ingot and rapidly cooling the melt alloy through a high-speed rolling.

The ingot having a ribbon shape may be pulverized by a device which carries out milling, and the powder thus pulverized may be the magnetic powder in Step (a). The HDDR process is a process in which a magnetic powder is manufactured through hydrogenation, disproportionation, dehydrogenation, and recombination processes.

The magnetic powder may be a polycrystalline particle including a plurality of crystal grains therein, the magnetic powder may have an average particle size of 100 to 500 μm, and the polycrystalline particle may be generally a multi domain particle including a plurality of domains.

When an existing sintered magnet is manufactured, the magnetic powder should be pulverized to have a powder particle diameter of about 3 μm, such that the particle size of the magnetic powder becomes a single crystal, and as a result, the magnetic field is easily aligned before the sintering process is carried out. Accordingly, when the magnetic powder is prepared, the rolling of a strip caster cooling wheel should be performed at low speed, and milling should be also subjected to crude pulverization and minute pulverization processes. In contrast, the magnetic powder of the present invention may bring about an effect of reducing the costs for the pulverization process and energy because the magnetic powder is sufficient as long as the magnetic powder is a polycrystalline particle in which a plurality of crystal grains is present therein or an amorphous particle, and has an average particle size of 100 μm to 500 μm.

Step (b) may be a step of press sintering the magnetic powder prepared in Step (a).

The press sintering step may be applied as long as the sintering is a method which may be carried out, the method is not particularly limited, but for example, a hot press sintering, a hot isostatic pressing sintering, a spark plasma sintering, a furnace sintering, a microwave sintering, or a combination method thereof, and the like may be applied.

The press sintering step may be carried out under the conditions of a temperature of 300° C. to 800° C. and a pressure of 30 MPa to 1,000 MPa. When the press sintering is carried out at the temperature, the non-magnetic alloy may be primarily distributed at the crystal grain interface in the magnetic powder, and each of the magnetic powders is densely packed, and a result, a sintered body having a dense structure may be obtained. However, even in this case, the form of powder particles in the sintered body may be still spherical or other irregular forms, and may be just a structure in which powder particles are densely compressed, and accordingly, the powder particles may be generally in a state where magnetic characteristics are not exhibited because the magnetization directions of domains in each powder coincide with each other. In this case, the crystal grains in the magnetic powder particle may have a size of about 30 nm to about 100 nm.

Step (c) may be a step of hot-pressing and deforming the sintered body formed in step (b) under conditions of a predetermined temperature and a predetermined pressure.

Since Step (c) is a step which may be carried out at a temperature and a pressure which are higher than those in the press sintering, and may be a step of compressing the densely formed magnet, Step (c) is a step in which the easy axis of magnetization in the particles in a state of being densely present in the sintered body are rotated in a direction which is the same as the pressure direction and most of the particles are grown in a direction which is the same as the pressure direction, and as a result, the width is increased, and may be carried out in a device in which all directions are open or closed. The step may be carried out in a device in which all directions are open, and which is vertical to a direction in which pressure is applied such that the thickness of the sintered body may be reduced and the width thereof may be increased.

In the press sintering process, a sintered body having densely packed magnetic powders is formed, and is strongly compressed due to high pressure in a hot-press and deformation process, and as a result, the magnetic powder particle and crystal grains having a size of approximately 30 to 100 nm present therein are deformed in a plate shape, and crystal grains deformed into the shape have a magnetization direction aligned in one direction due to crystallographic characteristics and thus have an anisotropy, and as a result, magnetic characteristics may be exhibited.

The hot-press and deformation step may be carried out under the conditions of a temperature of 500° C. to 1,000° C. and a pressure of 50 MPa to 1,000 MPa. The hot-pressing and deformation may be carried out such that the deformation ratio is adjusted to about 50% to about 80%, and the deformation ratio may be achieved in the aforementioned ranges of temperature and pressure. That is, when the temperature is less than 500° C. or the pressure is less than 50 MPa, and as a result, the deformation ratio is less than 30%, particles and crystal grains may not be deformed in a plate shape to a degree that the magnetization direction may be aligned due to crystallographic characteristics, and when the temperature is more than 1,000° C., a rapid particle growth occurs.

As described above, the method may not include a step of forming a magnetic field, which applies an external magnetic field. When crystal grains are deformed into a plate shape through continuous compression due to the hot deformation as in the present invention, the magnetization direction is aligned in one direction in crystallographically plate-shaped crystal grains even though a magnetic field is not imparted to a magnet by applying an external magnetic field, thereby having excellent residual magnetic flux density. Accordingly, an effect which may reduce process costs and device costs is brought about because a device of imparting a magnetic field or a step such as forming a magnetic field is not needed.

Further, in the manufacturing method of the present invention, a non-magnetic alloy having a melting point of more than 0° C. and 850° C. or less may be added at the time of manufacturing the R-TM-B alloy in Step (a), or before the press sintering in Step (b).

The non-magnetic alloy may be included at the interface of the crystal grains, and the time for addition is not particularly limited, but may be sufficient as long as the non-magnetic alloy is added before the hot-pressing and deformation is carried out, and the time for addition may be preferred as long as the non-magnetic alloy is added before the press sintering is carried out.

The non-magnetic alloy may be applied without limitation as long as the non-magnetic alloy has a low solid solubility with respect to the R-TM-B-based magnetic powder which is a main phase, and is uniformly distributed at the interface of the crystal grains without difficulty.

The non-magnetic alloy is a low-melting point alloy, may have a melting point of more than 0° C. and 850° C. or less, and may have a melting point of preferably 400° C. to 700° C.

When the melting point of the non-magnetic alloy is present in the temperature range, the melting point of the non-magnetic alloy may be lower than the temperature range during the press sintering process in Step (b) or during the hot-press and deformation process in Step (c) in most cases, and accordingly, the non-magnetic alloy may easily diffuse, and as a result, the non-magnetic alloy coated on the surface of the magnetic powder particle may be uniformly distributed inside the crystal grain interface through the aforementioned diffusion.

The non-magnetic alloy may be represented by the following Chemical Formula 2.

[Chemical Formula 2]

$T_aM_{1-a}$ (here, T is any one element selected from the group consisting of Nd, Dy, Pr, Tb, Ho, Sm, Sc, Y, La, Ce, Pm, Eu, Gd, Er, Tm, Yb, and Lu, M is any one metal element selected from the group consisting of Cu, Al, Sb, Bi, Ga, Zn, Ni, Mg, Ba, B, Co, Fe, In, Pt, Ta, and a combination thereof, and a is a real number with $0<a<1$.)

The applicability of the non-magnetic alloy is not limited, but in consideration of frequency of usage or other circumstances, and the like, it may be preferred to apply, for example, an Nd-based alloy or a Pt-based alloy, and the like in which the eutectic point of each of the alloys is generally positioned between 400° C. and 700° C.

Specifically, the non-magnetic alloy may include any one selected from the group consisting of $Nd_{0.84}Cu_{0.16}$, $Nd_{0.7}Cu_{0.3}$, $Nd_{0.85}Al_{0.15}$, $Nd_{0.08}Al_{0.92}$, $Nd_{0.03}Sb_{0.97}$, $Nd_{0.8}Ga_{0.2}$, $Nd_{0.769}Zn_{0.231}$, $Nd_{0.07}Mg_{0.93}$, $Pr_{0.84}Cu_{0.16}$, $Pr_{0.7}Cu_{0.3}$, $Pr_{0.85}Al_{0.15}$, $Pr_{0.08}Al_{0.92}$, $Pr_{0.03}Sb_{0.97}$, $Pr_{0.8}Ga_{0.2}$, $Pr_{0.769}Zn_{0.231}$, $Pr_{0.07}Mg_{0.93}$, Bi, Ga, Ni, Co, and a combination thereof, and it is possible to apply, for example, $Nd_{0.7}Cu_{0.3}$ having a melting point of 520° C., $Nd_{0.85}Al_{0.15}$ having a melting point of 635° C., $Nd_{0.08}Al_{0.92}$ having a melting point of 640° C., $Nd_{0.03}Sb_{0.97}$ having a melting point of 626° C., $Nd_{0.8}Ga_{0.2}$ having a melting point of 651° C., $Nd_{0.769}Zn_{0.231}$ having a melting point of 632° C., and $Nd_{0.07}Mg_{0.93}$ having a melting point of 545° C., and preferably, it is possible to apply an alloy having a melting point lower than 655° C., which is a melting point of the Nd-rich phase.

As described above, when a hot-pressed and deformed magnet is manufactured by adding the non-magnetic alloy, the Nd-TM-B crystals diffuse through the Nd-rich phases which become a liquid phase by high temperature and high pressure of the press sintering process and the hot-press and deformation process, and as a result, the crystals are grown through the a-axis of the Nd-TM-B crystal, and when Nd and the aforementioned non-magnetic alloy present at the eutectic point are added to the Nd-rich phase, the press sintering and hot-press and deformation processes can be carried out at a relatively low temperature which is lower by about 100° C. to about 200° C. than those of the existing press sintering and hot-pressing, as described above.

That is, when Nd and the aforementioned non-magnetic alloy present at the eutectic point are added to the Nd-rich phase, the melting point may be further lowered than 655° C. which is a melting point of the existing single Nd-rich phase, and as the melting point is lowered, the Nd-TM-B crystal phase being the main phase is decomposed and diffuses, and the growing process can be carried out at a lower temperature, and accordingly, a low-melting point metal compound eliminates the surface defects of the Nd-TM-B crystals being a main phase, and simultaneously, coarsening of crystal grains is less likely to occur at such a low temperature, so that ultimately, a more improvement in coercive force may be promoted.

When the non-magnetic alloy is added before the press sintering in Step (b), the powder of the non-magnetic alloy and the magnetic powder may be mixed by any method such as a dry method or a wet method, and a mixing method may be selected without particular limitation as long as the non-magnetic alloy can be uniformly applied onto the surface of the magnetic powder.

Further, in the case of a wet method, it is possible to apply a method of adding the two powders to a solvent, uniformly distributing the powders, and then drying the solvent. At this time, the solvent does not include moisture or carbon, it is possible to select a solvent which can minimize oxidation of the magnetic powder and degradation of magnetic characteristics, and a solvent may be applied without particular limitation as long as the solvent satisfies the conditions as described above.

As in the existing method, when a non-magnetic alloy is surface coated on the manufactured magnet to induce diffusion of the non-magnetic alloy, the non-magnetic alloy diffuses from the surface of the magnet, so that the non-magnetic alloy fails to be sufficiently distributed inside the crystal grain interface, that is, to the central portion of the magnet, and as a result, a significant effect of magnetic shielding may not be obtained.

Meanwhile, since the non-magnetic alloy may be distributed on the surface of each magnetic powder by mixing the non-magnetic alloy with the magnetic powder in the present invention, the non-magnetic alloy distributed on the surface of each magnetic powder primarily permeates and diffuses inside the magnetic powder at the time of press sintering, and thus may be distributed at the interface of crystal grains. That is, since the non-magnetic alloy begins to diffuse from the surface of the magnetic powder, a perfect magnetic shielding may be uniformly achieved inside and outside the magnet, and accordingly, an improvement in coercive force may be promoted.

The non-magnetic alloy may be included in an amount of 0.01 wt % to 10 wt % based on the weight of the magnetic powder. When the non-magnetic alloy is included in an amount of less than 0.01 wt %, and accordingly, the amount is too small, the amount may be small for the non-magnetic alloy to be sufficiently distributed at the interface of the crystal grains included in the magnetic powder, and accordingly, the magnetic shielding of the crystal grains may not be normally achieved, and when the non-magnetic alloy is included in an amount of more than 10 wt %, only the non-magnetic alloy is aggregated due to the addition in an excessive amount, and as a result, a non-magnetic phase, which is unnecessary, is present in the magnet, so that there is a concern in that the magnetic characteristics are adversely affected.

When the non-magnetic alloy is added in Step (b) in the method for manufacturing a hot-pressed and deformed magnet of the present invention, it is possible to further include a step of subjecting the sintered body to an additional heat treatment between Steps (b) and (c). The heat treatment in this step may be carried out at a temperature of 400° C. to 800° C., and may be carried out for 24 hours or less. The temperature and treatment time for the heat treatment may be adjusted according to the melting point of the non-magnetic alloy to be added, and when the temperature is more than 800° C., the growth of crystal grains occurs due to the presence of the non-magnetic alloy distributed at the interface of crystal grains, and as a result, there is a concern in that crystal grains are coarsened, so that it is preferred that the heat treatment is carried out in the temperature range.

The additional heat treatment may be a step which allows the non-magnetic alloy to be uniformly distributed at crystal grain interface inside and outside the magnet, and induces an effect of a more perfect magnetic shielding by uniformly distributing the non-magnetic alloy, and the coercive force of a finally manufactured magnet may be further improved through the heat treatment as described above.

As described above, the non-magnetic alloy may primarily permeate and diffuse into the crystal grain interface of the non-magnetic alloy at the time of the press sintering, and the non-magnetic alloy distributed on the surface of the magnetic powder may secondarily permeate and diffuse into the crystal grain interface inside the non-magnetic alloy during the hot-press and deformation, and as a result, the non-magnetic alloy may be more uniformly distributed at the interface of the crystal grains.

Meanwhile, in order to improve the coercive force of the magnet, there may be a method of inducing the effect of magnetic shielding by reducing the size of the particles present inside the magnet to the size of the single magnetic domain, and then preventing coarsening of crystal grains by the growth of crystal grains during the manufacturing process, or distributing a non-magnetic phase not only at the interface of powder particles, but also at the interface of the crystal grains included inside the powder particle to isolate the power particles or the crystal grains.

In the present invention, since the non-magnetic alloy inside the sintered body is distributed not only at the interface of the powder particles, but also at the crystal grain interface inside the non-magnetic alloy by mixing the non-magnetic alloy with the magnetic powder in advance, and inducing permeation and diffusion of the non-magnetic alloy inside the powder particles several times, the isolation of particles or crystal grains is achieved by the non-magnetic alloy, and accordingly, the coercive force may be significantly improved.

Further, as a measure of evaluating the performance of the magnet together with the coercive force, a residual magnetic flux density, which can be defined as a degree of alignment of the magnetization direction of each crystal grain or domain, and each domain, may be affected, and the magnetization direction of each domain may be aligned in one direction by using crystallographic characteristics by means of the hot-press and deformation as described above, so that excellent residual magnetic flux density may be obtained.

Further, the coercive force may also be improved through coarsening of crystal grains or easy diffusion of the non-magnetic alloy by lowering the melting point of the Nd-rich phase to decrease the temperature of the press sintering and hot-press pressurization processes, and when a magnet is manufactured by mixing a non-magnetic alloy with a magnetic powder, the non-magnetic alloy is disposed on the surface of the magnetic powder instead of the surface of the magnet to allow the non-magnetic alloy to easily diffuse into the crystal grain interface inside the powder particle, and as a result, crystal grains may be completely surrounded to achieve a perfect magnetic shielding, thereby improving the coercive force.

An R-TM-B-based (R means any one rare earth metal selected from the group consisting of Nd, Dy, Pr, Tb, Ho, Sm, Sc, Y, La, Ce, Pm, Eu, Gd, Er, Tm, Yb, Lu, and a combination thereof, and TM means a transition metal) hot-pressed and deformed magnet includes: anisotropic plate-shaped crystal grains; and a non-magnetic alloy distributed at the interface of the crystal grains.

The R-TM-B-based hot-pressed and deformed magnet may be represented by the following Chemical Formula 1.

[Chemical Formula 1]

$(R'_{1-x}R''_{x})_2TM_{14}B$

Here, R' and R" are any one rare earth metal selected from the group consisting of Nd, Dy, Pr, Tb, Ho, Sm, Sc, Y, La, Ce, Pm, Eu, Gd, Er, Tm, Yb, Lu, and a combination thereof, and x is a real number with $0 \leq x \leq 1.0$).

The anisotropic plate-shaped crystal grains present inside the particle may have a major axis of 100 nm to 1,000 nm.

Since all the descriptions on the non-magnetic alloy, description on the anisotropic plate-shaped crystal grains, and the description on the plate-shaped particles including the same are overlapped with those explained in the above-described method for manufacturing a hot-pressed and deformed magnet, a detailed description thereof will be omitted.

The method for manufacturing a hot-pressed and deformed magnet of the present invention may distribute a non-magnetic alloy into the interface of the crystal grains inside the magnetic powder particle by adding the non-magnetic alloy before carrying out the press sintering, and introducing a hot-press and deformation step, and as a result, the isolation of particles or crystal grains is achieved by the non-magnetic alloy, so that a hot-pressed and deformed magnet having improved coercive force and residual magnetic density may be manufactured by a more economic process.

BRIEF DESCRIPTION OF THE DRAWINGS

FIG. 1 illustrates the TEM observation photographs of the crystal grain interfaces of the permanent magnets manufactured in (a) Comparative Example 1, (b) Example 2, and (c) Example 3;

FIG. 2 illustrates the EDS-mapping analysis photographs of the permanent magnets manufactured in (a) Example 2 and (b) Example 3; and FIG. 3 illustrates the SEM observation photographs of Example 4-3 (a) before the heat treatment and (b) after the heat treatment.

MODES FOR CARRYING OUT THE PREFERRED EMBODIMENTS

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, exemplary embodiments of the present invention will be described in detail such that a person skilled in the art to which the present invention pertains can easily carry out the present invention. However, the present invention can be implemented in various different forms, and is not limited to the exemplary embodiments described herein.

EXAMPLE

Example 1

Preparation of Magnetic Powder

An alloy in the form of a ribbon was prepared by melting an NdFeB-based powder ($Nd_{30}B_{0.9}Co_{4.1}Ga_{0.5}Fe_{Bal.}$) being a raw material, and injecting the melt into a cooling roll which was rotated at high speed (a melt spinning process). A magnetic powder was prepared by milling an ingot in the form of a ribbon produced by the rolling process to pulverize the ingot into a size of about 200 μm.

Example 2

Manufacture of Hot-Pressed and Deformed Magnet Including Non-Magnetic Alloy $Nd_{0.84}Cu_{0.16}$ as a non-magnetic alloy was added in an amount of each of 0.5 wt % (Example 2-1), 1.0 wt % (Example 2-2), and 1.5 wt % (Example 2-3) based on the weight of the magnetic powder, and the powders were mixed with each magnetic powder (the magnetic powder prepared in Example 1) by a dry method.

Thereafter, the mixed powders were injected into an extrusion mold for forming (press sintering) and were pressurized at a pressure of about 150 MPa and a temperature of about 700° C., and as a result, a press sintering was carried out by using a hot press, such that the relative density became 99%.

Subsequently, pressure was applied to a sintered body extruded and formed from the mold at about 750° C. by using a press device in which all directions were open, and as a result, a hot-press and deformation was carried out at a deformation ratio of about 70%, such that crystal grains in the magnetic powder became plate-shaped. Due to the pressurization, the magnetization direction of crystal grains included in each powder particle was aligned in one direction, thereby manufacturing anisotropic hot-pressed and deformed magnets including the non-magnetic alloy in an amount of 0.5 wt %, 1.0 wt %, and 1.5 wt %, respectively (Examples 2-1 to 2-3, respectively).

Example 3

Manufacture of Hot-Pressed and Deformed Magnet Including Non-Magnetic Alloy

An anisotropic hot-pressed and deformed magnet was manufactured in the same manner as in Example 2, except that $Pr_{0.84}Cu_{0.16}$ was used instead of $Nd_{0.84}Cu_{0.16}$ (wt %) as the non-magnetic alloy.

Example 4

Manufacture of Hot-Pressed and Deformed Magnet Subjected to Additional Heat Treatment Hot-pressed and deformed magnets were manufactured in the same manner as in Example 2 (Examples 4-1 to 4-3, respectively), except that the sintered bodies subjected to press sintering in Example 2 (Examples 2-1, 2-2, and 2-3) were subjected to an additional heat treatment at a temperature of about 575° C. for about 2 hours.

Comparative Example 1

Manufacture of Hot-Pressed and Deformed Magnet To Which Non-Magnetic Alloy is not Added A hot-pressed and deformed magnet was manufactured in the same manner as in Example 2, except that a non-magnetic alloy was not added to the magnetic powder prepared in Example 1.

Evaluation Example

1) Observation of Internal Structure by Using Electronic Microscope

For the hot-pressed and deformed magnets in Examples 2 and 3 and the magnet in Comparative Example 1, photographs capturing the internal structures thereof are illustrated in FIG. 1 by using a transmission electron microscope (TEM). Through the photographs, it could be confirmed that the shape surrounding the crystal grains in the magnet in Comparative Example 1 could not be observed, but the Nd-rich phase was present at the crystal grain interface in the magnets in Examples 2 and 3.

2) Analysis of Composition

For the hot-pressed and deformed magnets in Examples 2 and 3, an EDS-mapping analysis was carried out, and the results thereof are illustrated in FIG. 2. Through FIG. 2, it could be confirmed that an Nd-based compound or a Pr-based compound, which was a low-melting point metal compound, was contained inside the hot-pressed and deformed magnets in Examples 2 and 3.

3) Evaluation of Magnetic Characteristics

For the hot-pressed and deformed magnets in Examples 2 to 4 and the sintered magnets in Comparative Examples 1 and 2, the coercive force and residual magnetic flux density being performance measures of a magnet were evaluated by using a vibrating sample magnetometer (VSM, Lake Shore #7410 USA), and the result values thereof are shown in the following Table 1.

TABLE 1

| Amount of non-magnetic alloy added (wt %) | Before heat treatment (kOe) (Example 2) | After heat treatment (kOe) (Example 4) | Improvement ratio (%) |
|---|---|---|---|
| 0.0 (Comparative Example 1) | 14.2 | 15.2 | 7 |
| 0.5 (Examples 2-1 and 4-1) | 15.9 | 17.9 | 13 |
| 1.0 (Examples 2-2 and 4-2) | 16.6 | 18.5 | 11 |
| 1.5 (Examples 2-3 and 4-3) | 17.1 | 18.9 | 11 |

Referring to Table 1, it could be confirmed that when the additional heat treatment was carried out as in Example 4, the non-magnetic alloy was more uniformly distributed at the interface of the crystal grains, and accordingly, the coercive force was improved by about 10% to about 15% than those in the magnets in Examples 2 and 3.

Further, through FIG. 3, it could be confirmed that the additive diffused in a larger amount into the crystal grain interface inside the powder after the heat treatment than before the heat treatment.

Through this, it could be confirmed that since the magnet in Comparative Example 1, in which the interface of the crystal grains was not surrounded by the non-magnetic alloy, failed to perfectly achieve the magnetic shielding, the Nd-rich phase was discharged outside the crystal grains, and as a result, the coercive force was exhibited at a low level, whereas it could be confirmed that in Examples 2 to 4 where the magnetic shielding was perfectly achieved by adding the non-magnetic alloy to surround the interface of the crystal grains, the coercive force was improved.

Although preferred examples of the present invention have been described in detail hereinabove, the right scope of the present invention is not limited thereto, and it should be clearly understood that many variations and modifications of those skilled in the art using the basic concept of the present invention, which is defined in the following claims, will also fall within the right scope of the present invention.

The invention claimed is:

1. A method for manufacturing an R-TM-B hot-pressed and deformed magnet, the method comprising the steps of:

(a) preparing a magnetic powder from an R-TM-B alloy, wherein the R-TM-B is $Nd_{30}B_{0.9}Co_{4.1}Ga_{0.5}Fe_{Bal}$;

(b) manufacturing a sintered body by press sintering the magnetic powder; and (c) hot-pressing and deforming (hot deformation) the sintered body by applying heat and pressure, wherein the method further comprises adding and mixing a non-magnetic alloy at a time before the press sintering in Step (b), wherein the magnetic powder is a polycrystalline particle including a plurality of crystal grains, wherein the polycrystalline particle is a multi domain particle including a plurality of domains, wherein an average particle size of the magnetic powder is 100 μm to 500 μm, wherein the non-magnetic alloy comprises a Nd-rich phase, wherein the non-magnetic alloy further comprises $Nd_{0.84}Cu_{0.16}$ or $Pr_{0.84}Cu_{0.16}$, wherein the magnetic powder comprises a magnetic powder manufactured by any one process selected from the group consisting of a hydrogenation disproportionation desorption and recombination (HDDR) process, a melt spinning process, a rapid solidification process, and a combination thereof, wherein the non-magnetic alloy is added in an amount of 0.5 wt % to 1.5 wt % based on a weight of the magnetic powder, wherein Step (b) is carried out at a temperature of 300° C. to 800° C., wherein Step (c) is carried out at a temperature of 500° C. to 1,000° C., wherein the non-magnetic alloy is added before the press sintering in Step (b), and is mixed with the magnetic powder, wherein the method further comprises a step of subjecting the sintered body to an additional heat treatment between Steps (b) and (c), wherein the additional heat treatment is carried out at a temperature of 400° C. to 800° C., and wherein a deformation ratio of the hot-pressing and deformation in Step (c) is 50% to 80%.

* * * * *